US006322720B1

(12) United States Patent
Reutova et al.

(10) Patent No.: US 6,322,720 B1
(45) Date of Patent: Nov. 27, 2001

(54) NONEVAPORABLE GETTER

(75) Inventors: Nina Pavlovna Reutova; Sergey Jurievich Maneghin; Jury Mikhailovich Pustovoit; Vladimir Leonidovich Stoljarov; Vladimir Borisovich Akimenko, all of Moscow (RU)

(73) Assignee: Tovarischestvo S Ogranichennoi Otvetstvennost Ju "Tekhnovak+", Moscow (RU)

( * ) Notice: Subject to any disclaimer, the term of this patent is extended or adjusted under 35 U.S.C. 154(b) by 0 days.

(21) Appl. No.: 09/407,320

(22) Filed: Sep. 28, 1999

Related U.S. Application Data

(63) Continuation of application No. PCT/IB98/00449, filed on Mar. 26, 1998.

(30) Foreign Application Priority Data

Mar. 28, 1997 (RU) ..... 97104447

(51) Int. Cl.[7] ..... H01J 7/18; B22F 1/00

(52) U.S. Cl. ..... 252/181.7; 252/181.6; 420/421; 420/422; 420/424

(58) Field of Search ..... 252/181.6, 181.7; 420/417, 421, 422, 424; 423/598, 608, 635

(56) References Cited

U.S. PATENT DOCUMENTS

| | | | | |
|---|---|---|---|---|
| 3,203,901 | * | 8/1965 | Porta | 252/181.6 |
| 4,312,669 | * | 1/1982 | Boffito et al. | 75/177 |
| 5,180,568 | * | 1/1993 | Boffito et al. | 423/246 |
| 5,814,241 | * | 9/1998 | Reutova et al. | 252/181.1 |
| 5,931,713 | * | 8/1999 | Watkins et al. | 445/55 |

FOREIGN PATENT DOCUMENTS

| | | |
|---|---|---|
| 863157A | 3/1941 | (FR) . |
| 1750256 | 7/1994 | (RU) . |
| 2034084 | 4/1995 | (RU) . |
| 1649827 | 6/1994 | (SU) . |

* cited by examiner

*Primary Examiner*—Joseph D. Anthony
(74) *Attorney, Agent, or Firm*—Akin, Gump, Strauss, Hauer & Feld, L.L.P.

(57) ABSTRACT

It is described a process for the production of porous non-evaporable getter materials comprising at least one first element selected between Zr and Ti and at least one second element selected among V, Cr, Mn and Ni, wherein the starting metal powders are produced by reduction with calcium hydride of the corresponding oxides and the thus obtained powders are compacted and sintered at a value of pressure and temperature in a given range; also described are getter materials that, due to the production process, have a novel distribution of chemical composition through the getter body resulting in an improved combination of mechanical and gas-sorption properties.

1 Claim, 3 Drawing Sheets

NONEVAPORABLE GETTER

CROSS-REFERENCE TO RELATED APPLICATION

This is a continuation application of PCT Application No. IB98/04499, filed Mar. 26, 1999, entitled "A Method for Producing a Non-evaporable Getter and a Getter Produced by said Method", the entire disclosure of which is hereby incorporated by reference.

BACKGROUND OF THE INVENTION

The present invention relates to powder metallurgy and more particularly to a process of producing nonevaporable getter materials and to getters manufactured therefrom, featuring enhanced mechanical and sorption properties.

Nonevaporable getters are well-known in the field of vacuum technology, and have been successfully used therein for more than thirty years for the provision and maintenance of a high vacuum level in different devices where vacuum is required: kinescopes, thermal insulation vessels and cathode-ray tubes, in elementary particle sources and accelerators (the thermonuclear fusion reactor of the TOKAMAK T-15 type) or the LEP (Large Electron-Positron) accelerator at CERN in Geneva, where the use of NGs makes it possible to reach a residual pressure below $10^{-10}$ Pa. Another broad field of NG application is the purification of inert gases. The best-known nonevaporable getters are alloys: Zr—Al, containing 84 weight % Zr, described in U.S. Pat. No. 3,203,901; a ternary alloy, having the composition 70 weight % Zr, 24.6 weight % V, and 5.4 weight % Fe, described in U.S. Pat. No. 4,312,669; and an intermetallic compound ZrMnFe described in U.S. Pat. No. 5,180,568. Getter elements are manufactured mainly from powders whose particle size varies from several microns to several hundreds of microns. Since loose powders in most cases can be used as getter elements, such powders are pressed into articles of different shapes (tablets, washers, disks, etc.) or rolled into strips. Porous getters with high sorption properties are manufactured as disclosed in U.S. Pat. No. 4,428,852; UK Patent No. 2,077,487; and German Patent No. 2,204,714.

In the information sources cited above, the getter material is produced by melting and subsequent crushing of the ingot down to powder; getters produced from these powder materials possess low mechanical properties.

Known in the art are getters made from powder alloys, described in RF Patent No. 1,649,827—a Zr—V—Ca composition, in RF Patent No. 2,034,084—a Ti—Cr—Ca composition, and in RF Patent No. 1,750,256, which is the closest in terms of the technical solution, the latter comprising preparation of powders for getter materials having the composition Ti—V—Ca by reducing a mixture of Ti and V oxides with calcium hydride in accordance with the main reaction $$MeO+CaH_2 \rightarrow Me+CaO+H_2\uparrow+Q \text{ kcal} \quad (1).$$

The reaction product is a mixture of powders of metals and CaO, sintered into a briquette ("sinter"). This "sinter" is then crushed and treated with hydrochloric acid to separate the metal powder from CaO; after that the powder is shaped. The reducing temperature is 1175° C. with 6 h keeping, and the resulting finished product is believed to be a powder alloy. However, an in-depth study showed that the abovesaid Ti—V—Ca composition is chemically heterogeneous and comprises predominantly a mixture of almost pure metallic particles which have not reacted with each other, and owing to such a high and non-regulated degree of chemical heterogeneity this getter material, though displaying a sufficiently high level of chemical properties with respect to all the above-mentioned materials, has insufficiently high gas-sorption properties. In the prior-art method, the reduction conditions, as well as non-regulated conditions of shaping and sintering the metal powder, do not allow to produce articles with equally high mechanical and sorption properties. In the prior art no information could be found on the interrelation of the mechanical and sorption properties of the getter with its chemical heterogeneity.

For the getter to meet all the requirements imposed on it, it must have very good mechanical properties along with high sorption characteristics with respect to such gases as $H_2$, $O_2$, $N_2$, CO, and the like. Low plasticity and strength do not provide sufficient resistance to mechanical loads and stresses caused by the processes of heat-cycling in the range from 300–700° C. to the ambient temperature. All this leads to disintegration of getters into separate fragments or to their crumbling, which cannot be tolerated in vacuum systems, e.g., in vacuum tubes, in elementary particle sources and accelerators, whereas low sorption properties cannot provide long-time maintenance of a residual pressure on the order of less than $10^{-10}$ Pa.

Therefore, the provision of getters noted for a combination of improved mechanical and sorption properties is an urgent problem. An extension of the range of materials used in the production of getters is a no less urgent problem.

SUMMARY OF THE INVENTION

In the proposed group of inventions the first subject solves the problem of providing getter material; the second subject relates to the getter produced, which combines enhanced mechanical and sorption properties. Investigations showed that a combination of enhanced mechanical and sorption properties is provided due to the definite degree of chemical heterogeneity of the getter material, the zones of relatively pure plastic metals which enter into the composition of the material and have poorly reacted with each other being responsible for the mechanical properties, and the zones of their interaction being responsible for the sorption activity level.

DETAILED DESCRIPTION OF THE INVENTION

Figure 1:
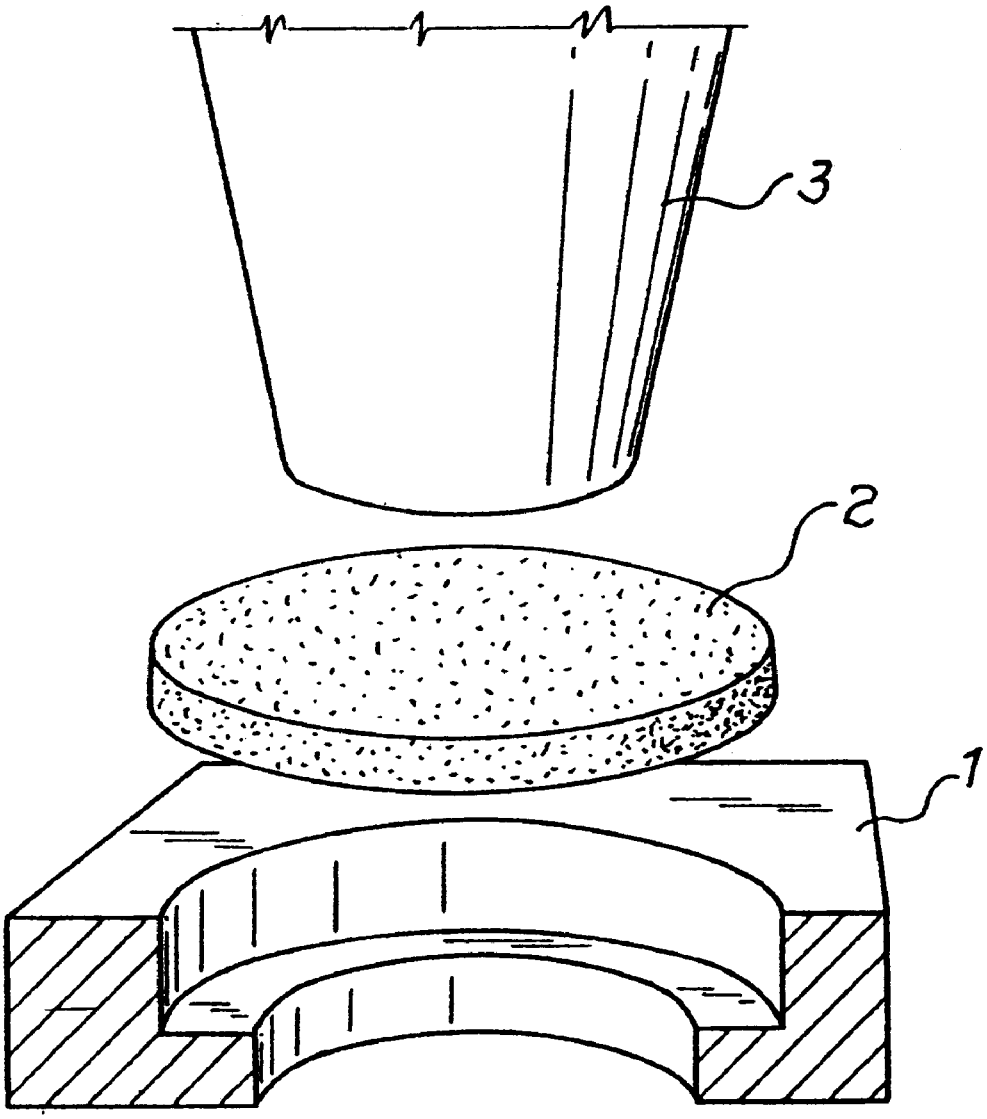
FIG. 1 is a perspective view of an appliance for determining the collapsing forces of getter materials, showing a punch 3, test sample 2, and mechanical die 1.

This is achieved in the following manner. As concerns the first subject of the invention—the method of producing a nonevaporable getter comprises preparing of a metallic powder by reducing the corresponding metal oxides entering into its composition with calcium hydride, subsequent shaping of the resulting powder and sintering thereof, the starting materials (metal oxides) being selected so as to obtain a metallic powder, whose first component comprises at least one element from the group of Ti, Zr, and whose second component comprises at least one element from the group of V, Cr, Mn, Fe, Ni; reduction is carried out at a temperature of 1180–1230° C. for 7–15 hours, powders are shaped at a pressure of 10–500 kg/cm$^2$ and sintered at 800–1100° C. In the second subject of the invention it is proposed to provide a nonevaporable getter with an improved combination of mechanical and sorption properties from a powder alloy, whose first component comprises at least one element from the group Ti, Zr, whose second component comprises at least one element from the group V, Cr, Mn, Fe, Ni, and whose third element is calcium oxide (CaO), the weight ratio of the first and second components being from 10:1 to 1:5, preferably from 5:1 to 1:2, the content of calcium content not exceeding 1 weight %; the content of said elements in the local zones of the getter is different, and the degree of chemical heterogeneity is determined from the premise that the arithmetic mean of the concentration ratios of each of the elements of the first and second components at arbitrarily selected several pairs of points should not exceed 30.

The essence of the invention, as regards the method, is in preparing a metallic powder of a prescribed chemical composition by reduction with calcium hydride. To this end, a mixture of metal oxides is prepared in a ratio corresponding to the quantitative and qualitative composition of the getter material, with $CaH_2$ added in an amount 1.1–1.2 times greater than the stoichiometrically required amount for reducing the oxides.

It should be pointed out that due to the high thermodynamic activity of the $CaH_2$ interaction with the oxides of such metals as iron and nickel, the reaction of their reduction is accompanied by liberation of a large quantity of thermal energy, and this may render the reaction difficult to control. Therefore, when preparing getter compositions containing iron, nickel, or their mixtures, the oxides of these metals in the composition of a charge intended for their reduction may be partially replaced by metallic powders of iron and nickel. The mixture of powders is charged into a container, the container is closed, heated to 1180–1230° C., and kept from 7 to 15 hours. Said temperature and process duration ranges in accordance with the present invention ensure the preparation of a metallic powder, whose particles are heterogeneous in their chemical composition: they differ in the ratio of the elements, i.e., the metallic powder of the getter material consists of particles, wherein zones with relatively pure metals and zones with different chemical composition are present, as a result of different degree of interaction between different metals.

At a temperature below 1180° C., complete reduction of the oxides is not ensured, and the resulting powder consists predominantly of strongly dispersed particles, while in the sintered article the degree of chemical heterogeneity is so high that the necessary level of sorption properties cannot be attained, whereas reduction at a temperature above 1230° C. leads to almost complete interaction between the particles of metals, yielding coarse conglomerates of particles (of 3 mm and over in diameter), having an almost homogeneous composition with CaO inclusions sintered in them. Depending on the composition of the getter material, individual particles of the resulting powder may undergo fusion. All this leads to a sharp lowering of the mechanical and sorption properties of getters manufactured from such powders.

The main object of the invention is to provide a metallic powder with a definite degree of chemical heterogeneity of particles as a result of different degree of interaction between the formed particles of pure metals. The duration of the process which allows the provision of the above-mentioned structure of the powder is a function of several parameters, including the composition of the getter material, the composition of the charge, and the reduction temperature. With the reaction time less than 7 hours, a powder is obtained, consisting of particles with a small degree of cross-doping, the degree of chemical heterogeneity of sintered getter material exceeds the permissible value, whereby sufficiently high sorption properties of the resulting getter are not ensured, whereas the reaction time more than 15 hours leads to a high chemical homogeneity of the metallic powder, where all the particles are closer in the chemical composition to the prescribed overall composition of the powder, the particles being conglomerates of finer metal particles; the size of these conglomerates may reach 1–3 mm. The getter manufactured from such particles-conglomerates possesses low mechanical and sorption properties.

The proposed reduction conditions, according to the present invention, favor the formation, in the first place, of chemical heterogeneity of the getter material, at which the zones of relatively pure plastic metals, i.e., zones with a low degree of interdiffusion of the metals entering into the composition of the alloys are responsible for the mechanical properties, while areas with a high degree of their interaction are responsible for sorption of gases; in the second place, the proposed reduction conditions favor the formation of spongy structure of the powder particles, where coalescence of metallic particles occurs by way of "light linkages" owing to the formation of "necks" or "bridges" between them, preserving thereby an open porous structure of getters, ensuring their high gas-sorption properties along with good mechanical properties.

The product obtained as a result of reduction—"sinter", comprising a mixture of a metallic powder and calcium oxide (CaO) is then crushed and treated with a hydrochloric acid solution to remove the major part of CaO. Crushing of the "sinter" is effected under sparing conditions so as to preserve the internal porous structure of particles, formed in the process of reduction, which causes high sorption properties of the getter. In the process of washing-off use is made of water and hydrochloric acid (HCl), which, reacting with CaO, yield calcium chloride ($CaCl_2$). $CaCl_2$ is readily soluble in water and can be easily removed. However, it is reasonable not to remove $CaCl_2$ completely, but leave it in an amount not over 1 weight %, because this component behaves later on as an anti-sintering agent.

Calcium oxide (CaO) favors the preservation of the porous structure of the getter under the conditions of its operation at temperatures of 300–400° C. and heat cycling in the range of 20–700° C. Under these conditions calcium oxide acts as an anti-sintering agent and preserves high sorption properties of the getter.

To impart a prescribed shape to getter elements, the powders are shaped. This operation must be carried out at low pressures, preferably in the range of from 10 to 500 kg/cm$^2$. At shaping pressures higher than the values indicated herein (above 500 kg/cm$^2$), the sorption properties of getter elements are impaired because of a decrease in their porosity, whereas at pressure values lower than 10 kg/cm$^2$ the produced getter elements possess low mechanical properties and disintegrate easily. Shaping can provide either individual articles or a continuous strip. In the first case powders are shaped in press molds; in the second case powders are shaped by continuous rolling between two rolls. Rolling can be performed, e.g., in a vertical direction, so that powder supply occurs by powder falling down. In this case pressure is controlled by varying the distance between the rolls and the powder mass that gets between the rolls per unit time. Articles obtained after shaping are sintered in vacuum or in an inert atmosphere at 800–1100° C. for 30–60 minutes. Sintering at temperatures lower than 800° C. lowers the mechanical properties of the getter, whereas a temperature increase to more than 1100° C. lowers the gas-sorption properties of getter elements because of their increased shrinkage.

The second subject of the invention relates to a getter element produced by the above-described method.

In accordance with the second subject of the present invention, a nonevaporable getter is made from an alloy, whose first component comprises at least one element from the group Ti, Zr, whose second component comprises at least one element of the group V, Cr, Mn, Fe, Ni, whose third component is calcium oxide (CaO), the weight ratio of the first and second components being from 10:1 to 1:5, preferably from 5:1 to 1:2, and the content of calcium oxide being not over 1 weight %; the content of said elements in local zones of the getter is different, i.e., the getter has a heterogeneous chemical composition throughout its mass, assuming the presence of local zones of relatively pure metals and zones differing in the degree of interaction between these metals. The degree of chemical heterogeneity of the getter is controlled by the difference in the concentration of each of the elements entering into the groups of the first and second components in the local zones of the getter, at which concentration the arithmetic mean of the concentration ratios of each of the elements at arbitrarily selected several pairs of points should not exceed 30.

The choice of titanium (Ti), zirconium (Zr) or their mixtures as one of the components of getter material is dictated by the fact that these elements are highly active gas absorbers, forming a continuous series of solid solutions with each other. Vanadium (V), chromium (Cr), iron (Fe), manganese (Mn), and nickel (Ni) or mixtures thereof are used as components lowering the activation temperature of the getter material. Said ratios of the elements of the first and second components improve the sorption properties of getters. The content of said elements in quantities beyond the scope of said ratios lowers the gas-sorption and mechanical properties of the produced getters. Calcium oxide, as an anti-sintering agent, makes it possible to obviate appreciable shrinkage in sintering; it also preserves the porous internal structure during service, when getter elements are heated repeatedly from the ambient temperature to 300–700° C. The content of calcium oxide higher than 1 weight % lowers the mechanical properties of the getter and increases its crumbling. CaO content should not exceed 1 weight %, preferably 0.5 weight %. The absence of CaO impairs the quality of the getter, decreasing its sorption properties, e.g., because of shrinkage in sintering and heat cycling in service.

The invention contemplates the use of a sufficiently broad range of materials for the provision of getters. This becomes possible due to the experimentally established influence of the chemical heterogeneity of an alloy from which the getter is manufactured on the mechanical and sorption properties of the getter. The degree of chemical heterogeneity of the elements entering into the groups of the first and second components recommended by the invention for use, is controlled by the difference in the concentration of each of the elements in the local zones, at which the arithmetic mean of the of the concentration ratios of each of the elements at arbitrarily selected several pairs of points should not exceed 30. It is preferable, that the lower limit of this particular parameter should be about 2. Investigations showed that the use of said materials alone in the manufacture of getters does not ensure the provision of getters possessing sufficiently high sorption and mechanical properties. In the manufacture of getters, only the use of said elements in said proportions with the stipulated degree of chemical heterogeneity in terms of the getter mass leads to the above-stated desirable effect. Broadening of the range of elements when choosing the composition of getter materials allows one to make the getter manufacturing process more economically advantageous, ecologically and fire-safe. If the chemical heterogeneity of the getter material exceeds the maximum permissible degree, the sorption properties of the getter become impaired drastically.

Figure 2:
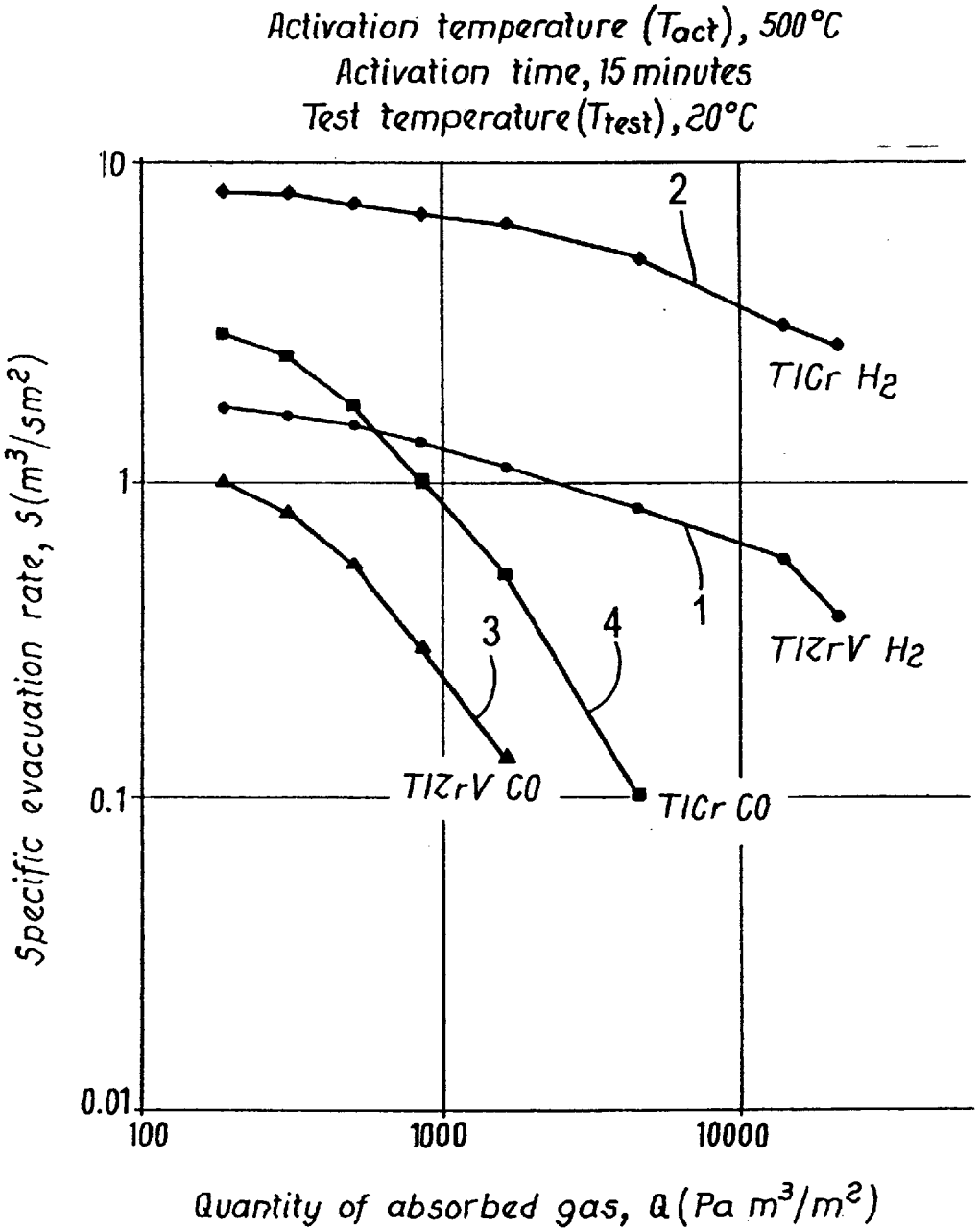
FIG. 2 is a graphical representation of the specific evacuation rate against the quantity of absorbed gas for a getter powder prepared according to Example 1 (curves 1 and 3), and for a getter powder prepared according to Example 2 (curves 2 and 4).
Figure 3:
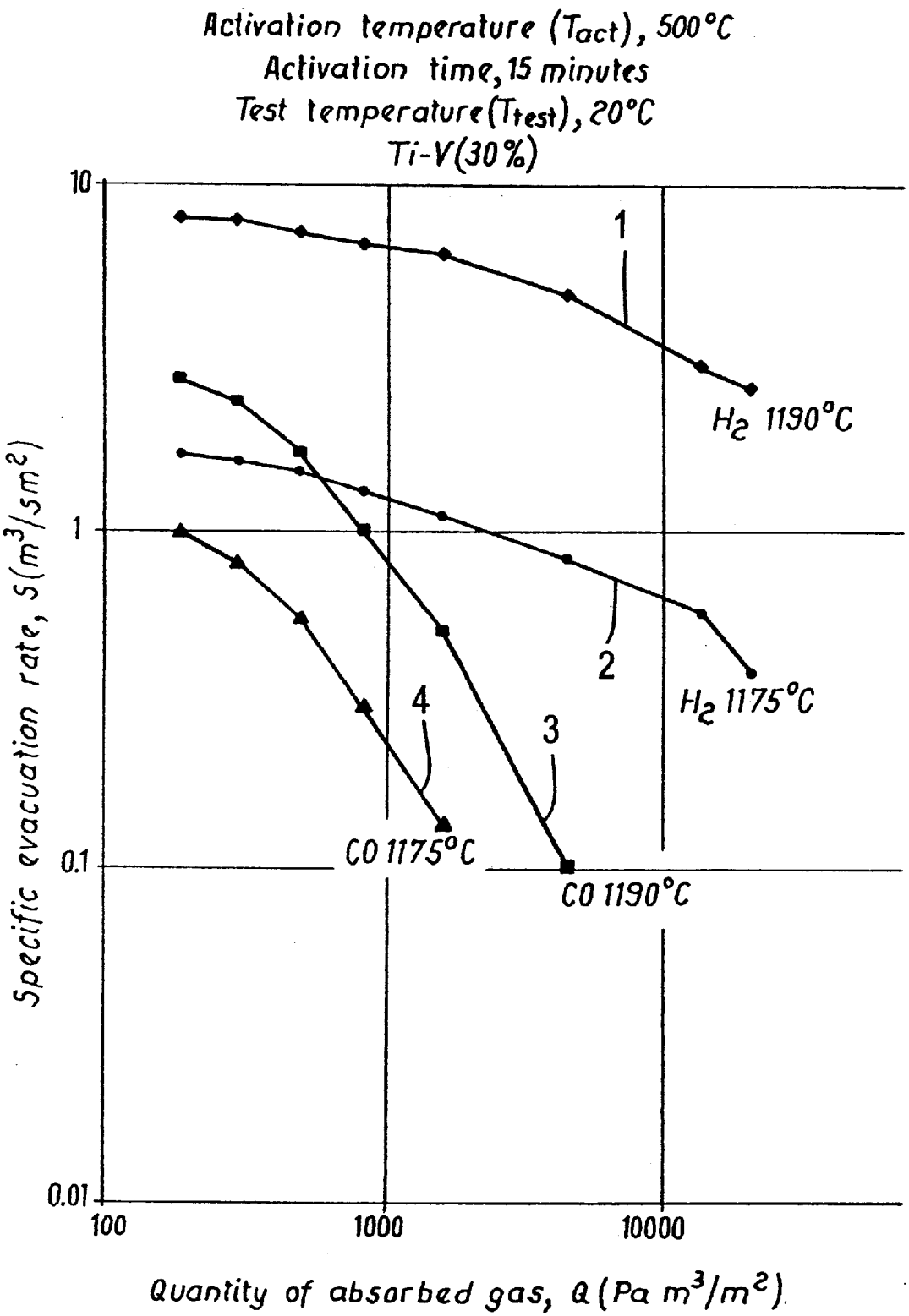
FIG. 3 is a graphical representation of the specific evacuation rate against the quantity of absorbed gas for a getter powder prepared according to Example 4 (curves 1 and 3), and for a getter powder prepared according to Example 5 (curves 2 and 4).

Examples illustrating the use of the invention are presented below, and the results of investigations are shown in FIGS. 1–3. FIG. 1 is a sketch of an appliance for determining the collapsing forces of getter materials. FIG. 2 shows the dependence of the gas sorption rate on the amount of absorbed gas for the compositions Ti—Zr—V and Ti—Cr. FIG. 3 shows the dependence of the gas sorption rate on the amount of absorbed gas for the composition TiV30, prepared in accordance with the invention: curve 1 corresponds to $H_2$, and curve 3 corresponds to CO; for the TiV30 composition prepared in accordance with the prior-art method curve 2 in FIG. 3 corresponds to $H_2$ and curve 4 corresponds to CO.

The level of mechanical properties of getter samples is estimated with the help of an appliance which is shown diagrammatically in FIG. 1. The appliance consists of metallic die 1 with an annular shoulder serving to support test sample 2 shaped as a tablet about 7.5 mm in diameter and 0.7 mm thick, and punch 3 about 6 mm in diameter. Force is imparted to the sample by means of the punch, and any load at the moment of testing is recorded by a system of sensors. A sharp drop of the load indicates destruction of the sample, and the last value of the load is recorded as the collapsing force (P). Tests were carried out on three samples, and the arithmetic mean of the collapsing force was calculated.

The sorption properties of getters produced in accordance with the invention and of samples produced by the prior-art method are determined in accordance with the procedures ASTM F 798-82, using hydrogen and carbon monoxide gas as the gases to be sorbed. The gas evacuation rate S ($m^3/m^2 \cdot s$) in FIGS. 2 and 3 is represented as a function of the amount of sorbed gas Q ($Pa/m^3/m^2$).

The degree of chemical heterogeneity is determined with the help of an electron-scan microscope by measuring the content of each of the elements of the first and second components, i.e., of Ti, Zr, V, Cr, Mn, Fe, Ni, in succession at several arbitrarily chosen pairs of points and finding at these points the value of the ratio (spread) of the concentrations of each of the elements by dividing the greater value by the smaller one and then by determining the mean arithmetic of the concentration ratios (spread) at the points of several pairs (the number of pairs is at least 3.

EXAMPLE 1

To prepare 1 kg of metallic powder, containing, in weight %: zirconium (Zr), 40; titanium (Ti), 30; vanadium (V), 30; oxides of said metals are taken in the following amounts, kg: zirconium dioxide ($ZrO_2$), 0.296; titanium dioxide ($TiO_2$), 0.497; vanadium trioxide ($V_2O_3$), 0.440; 1.31 kg of calcium hydride is added, i.e., the amount 1.2 times greater than the stoichiometric quantity necessary for reducing said quantity of the oxides. Said materials are mixed together and charged into a metallic container, heated to 1190° C., and kept for 9 hours. During the heating period, the hydrogen formed in accordance with reduction reaction (1) is removed from the container by combustion.

When the evolution of hydrogen ceases, argon is supplied to the container, and a pressure of about 0.2 atm is maintained therein till cooling is completed. In 9 hours the container is cooled down to room temperature, and its contents comprising a sintered mass ("sinter"), consisting of metallic particles and calcium oxide (CaO), are discharged. The "sinter" is crushed under a press into lumps about 10–50 mm in size, and the lumps are gradually, in small portions, transferred to a tank with water, where "liming" takes place in accordance with the reaction $CaO++H_2O \rightarrow Ca(OH)_2+Q$ kcal. The contents of the tank are treated further with hydrochloric acid (HCl) at pH 4–5 and washed with water to remove $CaCl_2$. The preservation of residual CaO in the finished metallic powder is controlled by the reaction of a wet powder sample with phenolphthalein; slight coloring is permissible.

After drying, the powder contains, in weight %: Ti, 29.6; V, 28.4; CaO, 0.21; Zr being the balance. The powder is rolled into 0.7×30×120 mm plates under a pressure of about 80 kg/cm$^2$ and sintered in vacuum at 880° C. for 1 hour.

X-ray diffraction analysis showed the presence in the resulting getter material of several phases having different compositions, as well as zones whose composition is close to pure metals, this being an indication that the getter material is chemically heterogeneous. The degree of chemical heterogeneity is determined as follows: the content of the elements is determined under an electron-scan microscope in five pairs (10 points) of arbitrarily chosen local zones. In the case discussed the chemical composition of the material at the 1$^{st}$ point proved to be, in weight %: Zr, 18.1; V, 21.0; Ti, 61.1; at the 2$^{nd}$ point: Zr, 64.0; V, 16.1; Ti, 21.9. The ratio of Zr concentration in the 1$^{st}$ pair of points is determined by dividing the greater value of Zr content by the smaller value, i.e., by dividing the result of Zr determination at the 2$^{nd}$ point by the result at the 1$^{st}$ point: 64.0:18.1=3.5.

the ratio of V concentrations in the first pair is determined by dividing the result at the 1$^{st}$ point by the result at the 2$^{nd}$ point: 21.0:16.1=1.3;

the ratio of Ti concentrations in the first pair is determined by division: 61.1:21.9=2.7.

The ratio of concentrations of the elements at the 2$^{nd}$, 3$^{rd}$, 4$^{th}$, and 5$^{th}$ pairs of the arbitrarily chosen zones is determined in a similar manner: points 3–4, 5–6, 7–8, and 9–10.

The results of measurements are presented in Table 1.

TABLE 1

Example 1
Results of determining chemical composition in arbitrarily chosen zones

| | Pair of points | | | | | | | | | | | | | | | |
|---|---|---|---|---|---|---|---|---|---|---|---|---|---|---|---|---|
| | 1$^{st}$ pair | | | 2$^{nd}$ pair | | | 3$^{rd}$ pair | | | 4$^{th}$ pair | | | 5$^{th}$ pair | | | Arithmetic |
| No. of points for elem. cont., wt. % | 1 | 2 | ratio $\sigma_1$ | 3 | 4 | ratio $\sigma_2$ | 5 | 6 | ratio $\sigma_3$ | 7 | 8 | ratio $\sigma_4$ | 9 | 10 | ratio $\sigma_5$ | mean ratio of concentrations $\sigma_{mean}$ |
| Zr | 18.1 | 84.0 | 4.6 | 38.4 | 31.6 | 1.4 | 71.1 | 8.4 | 8.5 | 6.2 | 54.7 | 8.8 | 11.2 | 69.4 | 6.2 | 5.9 |
| V | 21.0 | 8.1 | 2.6 | 2.5 | 49.0 | 19.6 | 2.2 | 68.6 | 31.2 | 19.1 | 41.6 | 2.74 | 2.4 | 28.2 | 11.7 | 13.56 |
| Ti | 61.1 | 7.9 | 7.6 | 59.1 | 19.4 | 3.0 | 26.7 | 23.0 | 1.16 | 74.8 | 3.7 | 20.2 | 86.4 | 2.4 | 36.0 | 13.6 |

The arithmetic mean values of the degree of chemical heterogeneity of each of said elements were as follows: Zr, 5.9; V, 13.5; and Ti, 13.6. Hence, the arithmetic mean values of the concentration ratios for each of the elements entering into the getter composition proved to be smaller than 30, and the resulting getter possesses a high sorption activity. The sorption properties of the produced getter, expressed as a dependence of the sorption rate on the quantity of absorbed gases at room temperature are shown in FIG. 2 curve 1 for $H_2$ and curve 3 for CO)

EXAMPLE 2

To prepare a powder containing, in weight %: chromium (Cr), 25; calcium oxide (CaO), less than 1; the balance being titanium (Ti), use is made of oxides $TiO_2$, $Cr_2O_3$, and calcium hydride. Their quantities are calculated in accordance with the reaction of reduction as in Example 1. The charge obtained after mixing the components together is heated to 1200° C., kept for 10 hours, and cooled down. Crushing and hydrometallurgical treatment are carried out as in Example 1. The resulting powder contains, in weight %: chromium (Cr), 23.6; calcium oxide (CaO), 0.24; titanium (Ti) being the balance. The prepared powder is rolled under a pressure of about 60 kg/cm$^2$ to produce a 0.7×20×120 mm plate, the latter being then sintered in vacuum at 900° C. for 0.5 hour. Investigations showed that the titanium to chromium weight ratio both in the powder and in the getter after sintering is different.

The degree of chemical heterogeneity in the getter is determined as described in Example 1 in five pairs of arbitrarily chosen points, at which the Ti and Cr content is measured under with the help of electron-scan microscope. The mean arithmetic values of the Ti and Cr concentration ratios proved to be smaller than 30 and were 4.8 and 11.7, respectively.

The gas sorption rate (S) as a function of the quantity of absorbed gas (Q) is shown in FIG. 2 (curve 2 for $H_2$ and curve 4 for CO).

EXAMPLE 3

To prepare 1 kg of a powder containing, in weight %: V, 30; CaO<1; Zr being the balance, a mixture is used, consisting of (in kg): $V_2O_3$, 0.440; $ZrO_2$, 0.945; $CaH_2$, 1.219. Further the preparation is carried out as in Example 1. Reduction is performed at 1200° C. for 10 hours. Unloading and further treatment of the powder are effected as in Example 1. The powder thus prepared contains, in weight %: vanadium (V), 29.1; CaO, 0.31; the balance being zirconium (Zr). Press-molding of the powder at a pressure of about 100 kg/cm$^2$ and subsequent sintering thereof at 900° C. for 1 hour gave getter elements in the form of tablets Ø 20 mm, h 10 mm; rolling of the powder gave 0.7×20×120 mm plates.

An x-ray spectrum analysis showed that the phases present in the getter sample are mainly an intermetallic compound $ZrV_2$ and zones of different degree of interdiffusion of Zr and V. CaO is present as separate inclusions.

The degree of chemical heterogeneity in the getter is determined as described in Example 1 in 5 pairs of arbitrarily chosen points, where the content of Zr and V was measured. The arithmetic mean values of the Zr and V concentration ratios proved to be smaller than 30 and equal to 6.1 and 17.3, respectively.

The initial sorption rate (S) with the quantity of absorbed gas Q to 133 Pa $m^3/m^2$ was about 4 $m^3/M^2$ s.

EXAMPLE 4

To prepare 1 kg of a metallic powder containing, in weight %: titanium (Ti), 70; vanadium (V), 30; and CaO no more than 1, in accordance with calculations, use is made of (kg): $TiO_2$ 1.160; $V_2O_3$, 0.440; and calcium hydride ($CaH_2$), 1.990. Carrying out the operations as described in Example 1, the mixture is reduced at 1190° C. for 12 hours. The resulting powder contains, in weight %: V, 28.9; CaO, 0.29, the balance being Ti. A 0.7×20×150 mm sample was produced by rolling the powder in rolls at a pressure of about 40 kg/$cm^2$ and subsequent sintering in vacuum at 850° C. for 1 hour.

Control carried out using an electron-scan microscope showed that the weight content of the elements entering into the composition of the getter material is different. The degree of chemical heterogeneity in the getter was determined as described in Example 1 in 6 pairs of arbitrarily chosen points, where the content of Ti and V was measured. The mean arithmetic values of the Ti and V concentration ratios proved to be smaller than 30, equal to 2.4 and 9.8, respectively.

FIG. 3 shows sorption curves for hydrogen (curve 1) and for carbon monoxide (curve 3). The collapsing force P for a sample of 6 mm in diameter and 0.7 mm thick was 37 N.

EXAMPLE 5

Metallic powder TiV30 is prepared as described in Example 4, and reduction of the oxides is performed as described in the prior-art method: the reduction temperature was 1175° C. and keeping time was 6 hours. The metallic powder thus prepared contains, in weight %: V, 29.45; CaO, 0.41; Ti being the balance. Getter plates are produced by shaping powders in rolls at a pressure of about 50 kg/$cm^2$ with subsequent sintering in vacuum at 850° C. for 0.5 hour.

The results of investigations showed that in the material thus produced the chemical heterogeneity compared with the material produced by the method of and in accordance with the invention (Example 4) is more pronounced.

The degree of chemical heterogeneity in the getter is determined as described in Example 1 in 8 pairs of arbitrarily chosen points, in which the content of Ti and V is measured. The arithmetic mean ratios of the Ti and V concentrations proved to be 24.6 and 34.1, respectively. It is apparent that while the nonuniformity of Ti distribution is higher than in Example 4 but does not exceed the maximum permissible value, the degree of nonuniformity of V distribution exceeded the regulated level, equal to 30. The obtained material possesses high mechanical properties. The collapsing force P for a 6 mm-diameter and 0.7 mm thick sample was 74 N, but its sorption properties are appreciably inferior to those of the material produced by the method of the present invention (see FIG. 3, curves 2 and 4), so that the getter cannot be used under conditions requiring a high vacuum with large gas flows.

Nonevaporable getters produced according to the invention posses high sorption properties for such gases as $H_2$, CO, $O_2$, $N_2$, and the like, in combination with sufficiently high mechanical properties. This makes such getters suitable for use in vacuum devices for establishing and maintaining a high vacuum level, e.g., in kinescopes, cathode-ray tubes, particle accelerators, etc., where their application contributes the attainment of residual pressures lower than $10^{-10}$ Pa.

What is claimed is:

1. A nonevaporable getter made from a powder alloy, characterized in that it is made from an alloy whose first component comprises at least one element from the group Ti, Zr, whose second component comprises at least one element from the group V, Cr, Mn, Fe, Ni, and whose third component is calcium oxide (CaO), the ratio of the first and second components in terms of the getter weight being from 10:1 to 1:5 and CaO content being not over 1%, the concentrations of said elements in local zones of the getter being uneven throughout the getter and such that the mean value of the ratios of concentrations measured by means of electron-scan microscopy for any selected element in at least three arbitrarily chosen pairs of points does not exceed 30.

* * * * *